313-414
11/18/80 XR 4,234,814

United States Patent [19]
Chen et al.

[11] 4,234,814
[45] Nov. 18, 1980

[54] ELECTRON GUN WITH ASTIGMATIC FLARE-REDUCING BEAM FORMING REGION

[75] Inventors: Hsing-Yao Chen, Landisville; Richard H. Hughes, Lancaster, both of Pa.

[73] Assignee: RCA Corporation, New York, N.Y.

[21] Appl. No.: 945,600

[22] Filed: Sep. 25, 1978

[51] Int. Cl.[3] ..... H01J 29/50; H01J 29/56
[52] U.S. Cl. ..... 313/412; 313/414; 313/449
[58] Field of Search ..... 313/412, 448, 449, 414, 313/413

[56] References Cited

U.S. PATENT DOCUMENTS

| | | | |
|---|---|---|---|
| 3,852,608 | 12/1974 | Johanns et al. | 313/449 |
| 3,866,081 | 2/1975 | Hasker et al. | 313/449 |
| 3,919,583 | 11/1975 | Hasker et al. | 313/448 |
| 3,952,224 | 4/1976 | Evans, Jr. | 313/414 |
| 3,970,890 | 7/1976 | Linssen | 313/413 |
| 4,143,293 | 3/1979 | Hosokoshi et al. | 313/414 X |

*Primary Examiner*—Palmer C. Demeo
*Attorney, Agent, or Firm*—E. M. Whitacre; G. H. Bruestle

[57] ABSTRACT

The gun, for use in a television picture tube, comprises a cathode, an apertured control grid, and an apertured screen grid aligned in the order named. The screen grid aperture comprises a rectangular slot portion facing the control grid and a circular portion facing away from the control grid. The slot portion of the aperture, which has a width 2–5 times its depth, creates an astigmatic field that produces underconvergence of the electron beam in the vertical plane only, whereby to avoid and/or compensate for vertical flare distortion of the beam spot at off-center positions on the image screen.

12 Claims, 6 Drawing Figures

ELECTRON GUN WITH ASTIGMATIC FLARE-REDUCING BEAM FORMING REGION

This invention relates to cathode ray tubes, and particularly to color picture tubes of the type useful in home television receivers, and to electron guns therefor. The invention is especially applicable to self-converging tube-yoke combinations with shadow mask tubes of the type having plural-beam in-line guns disposed in a horizontal plane, an apertured mask with vertically oriented slit-shaped apertures, and a screen with vertically oriented phosphor stripes. The invention is not, however, limited to use in such tubes and may in fact be used, e.g., in dot-type shadow mask tubes and index-type tubes.

An in-line electron gun is one designed to generate at least two, and preferably three, electron beams in a common plane and to direct the beams along convergent paths to a small area spot on the screen. A self-converging yoke is one designed with specific field nonuniformities which automatically maintain the beams converged throughout the raster scan without the need for convergence means other than the yoke itself.

BACKGROUND OF THE INVENTION

There has been a general trend toward in-line color picture tubes with greater deflection angles in order to provide shorter tubes. In a tube with 110° deflection, it has been found that the electron beams become excessively distorted as they are scanned toward the outer portions of the screen. Such distortions are commonly referred to as flare and appear on the screen of the tube as an undesirable low intensity tail or smear extending from a desirable intense core or spot. Such flare distortions are due, at least in part, to the effects of the fringe portions of the deflection field of the yoke on the beam as it passes through the electron gun, and to the nonuniformities in the yoke deflection field itself.

When the yoke's fringe field extends into the region of the electron gun, as is usually the case, the beams may be deflected slightly off axis and into a more aberrated portion of an electron lens of the gun. The result is frequently a flare distortion of the electron beam spot which extends from the spot toward the center of the screen. This condition is particularly troublesome in self-converging yokes having a toroidal vertical deflection coil, because of the relatively strong fringing of toroidal type coils.

Self converging yokes are designed to have a nonuniform field in order to increasingly diverge the beams as the horizontal deflection angle increases. This nonuniformity also causes vertical convergence of the electrons within each individual beam. Thus, the beam spots are overconverged at points horizontally displaced from the center of the screen, causing a vertically extending flare both above and below the beam spot.

The vertical flare due to both the effects of the yoke's fringe field in the region of the gun and to the nonuniform character of the yoke field itself is an undesirable condition which contributes to poor resolution of a displayed image on the screen.

SUMMARY OF THE INVENTION

An electron gun comprises a beam forming region including a cathode, a control grid (G1) and a screen grid (G2). The G2 comprises structural means on the G1 side thereof which causes an astigmatic electric field to be established, which causes underconvergence of the electron beam in one plane, e.g., a vertical plane, relative to the convergence of the beam in a plane perpendicular to the one plane. As a result, the underconverged beam is subjected to less of the off-axis aberrated portion of the electron lens of the gun when it is vertically deflected, and further compensates for the overconvergence provided by the yoke's deflection field at points horizontally displaced from the center of the screen. Both of these effects contribute to a reduction of the previously described vertical flare of the electron beam at points displaced from the center of the screen.

The astigmatic field-forming means preferably comprises a G2 including a first plate portion transverse to the electron beam path which has an electron beam aperture therethrough and a second plate portion facing the G1 which contains an elongated slot therethrough overlying the electron beam aperture. The two plate portions may comprise separate parts laminated together or different portions of a single integral member.

DETAILED DESCRIPTION OF THE PREFERRED EMBODIMENT

Figure 1:
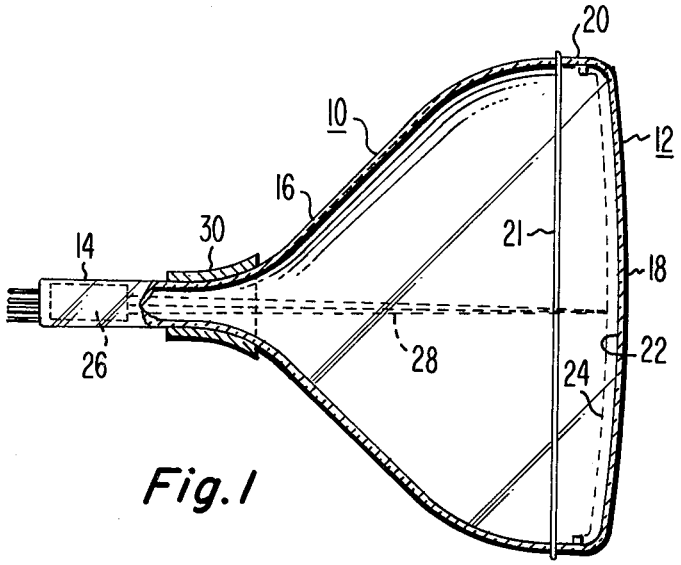
FIG. 1 is a schematic plan view of a cathode ray tube embodying the novel electron gun.
Figure 4:
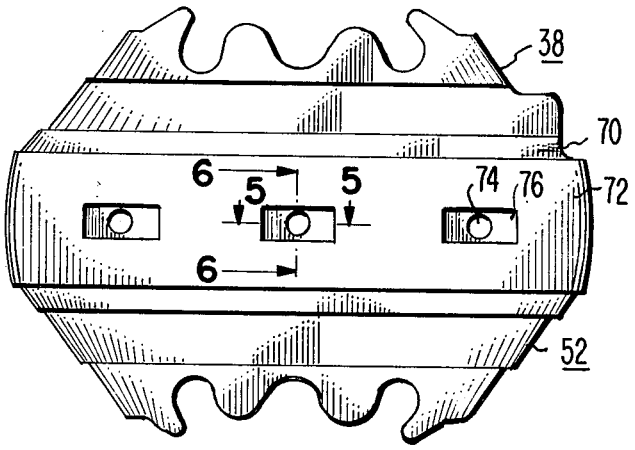
FIG. 4 is an elevation, taken along line 4—4 of FIG. 3, of the novel G2 electrode of the novel gun.
Figure 3:
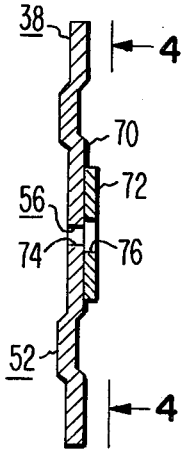
FIG. 3 is an enlarged section of the G2 electrode of FIG. 2.

FIG. 1 illustrates a rectangular color picture tube 10 having a glass envelope comprising a rectangular faceplate panel 12 and a tubular neck 14 connected by a rectangular funnel 16. The panel 12 comprises a veiwing faceplate 18 and a peripheral side wall 20 which is joined to the funnel 16 with a frit seal 21. A mosaic three-color phosphor screen 22 is disposed on the inner surface of the faceplate 18. The screen is preferably a line screen with the phosphor lines extending perpendicular to the intended direction of high frequency scanning. A multiapertured slit-type color selection shadow mask electrode 24 is removably mounted by conventional means in predetermined spaced relation to the screen 22. A novel in-line electron gun 26, shown schematically by dotted lines, is centrally mounted within the neck 14 to generate and direct three electron beams 28 along coplanar convergent paths through the mask 24 to the screen 22.

The tube of FIG. 1 is designed to be used with an external magnetic deflection yoke 30 disposed around the neck 14 and funnel 12 in the neighborhood of their junction, for scanning the three electron beams 28 horizontally and vertically in a rectangular raster over the screen 22. The yoke is preferably self-converging.

Except for the novel modifications as hereinafter described, the electron gun 26 may be of the 3-beam in-line type similar to that described in our copending application Ser. No. 895,588, filed Apr. 12, 1978 which itself discloses a modified version of the electron gun described in U.S. Pat. No. 3,772,554, issued to R. H. Hughes on Nov. 13, 1973. Our copending application and the Hughes patent are incorporated by reference herein for the purpose of disclosure.

Figure 2:
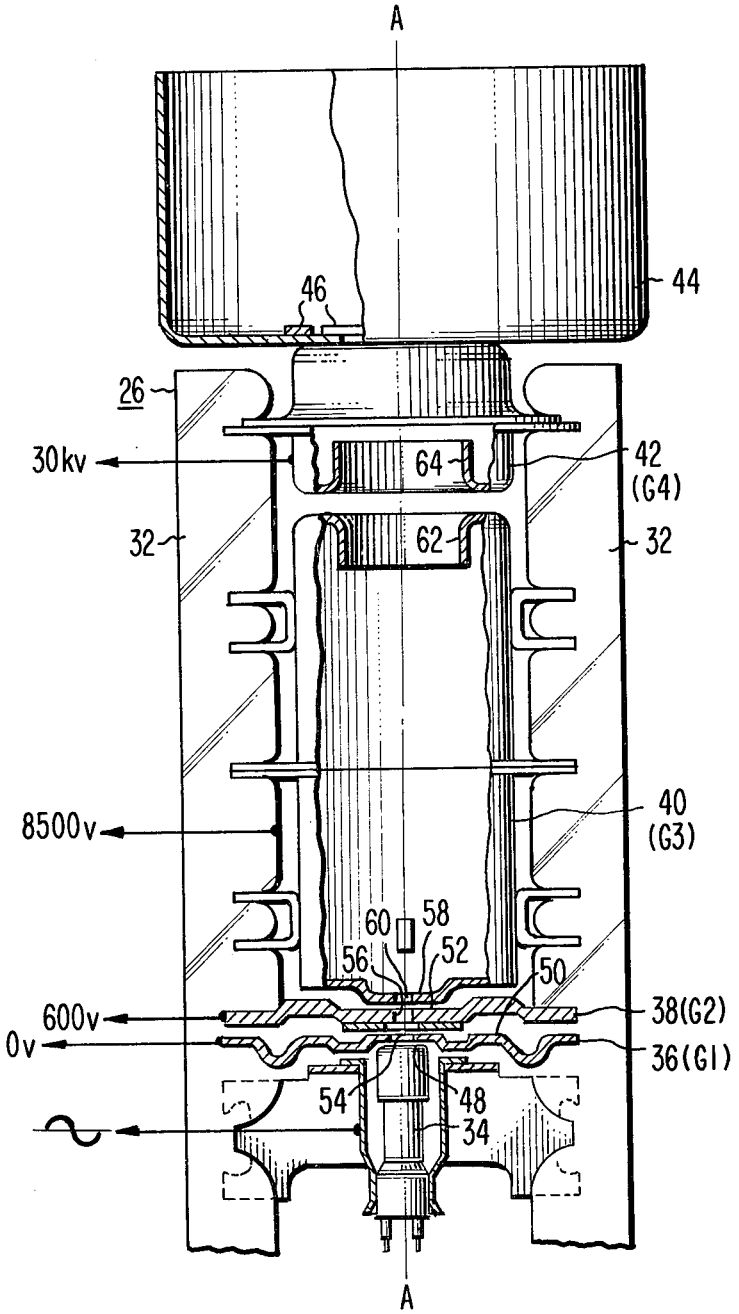
FIG. 2 is a longitudinal elevation, partly in section, of one embodiment of the novel electron gun of FIG. 1.

FIG. 2 is an elevation in partial central longitudinal section of the 3-beam electron gun 26, in a plane perpendicular to the plane of the coplanar beams of the three guns. As such, structure pertaining to but a single one of the three beams is illustrated in the drawing. The electron gun 26 is of the bipotential type and comprises two glass support rods 32 on which the various electrodes are mounted. These electrodes include three equally spaced coplanar cathodes 34 (one for each beam, only one of which is shown), a control grid (G1) electrode 36, a screen grid (G2) electrode 38, a first lens or focusing (G3) electrode 40, and a second lens or focusing (G4) electrode 42. The G4 electrode includes an electrical shield cup 44. All of these electrodes are aligned on a central beam axis A—A and mounted in spaced relation along the glass rods 32 in the order named. The focusing electrodes G3 and G4 also serve as accelerating electrodes in the bipotential gun 26.

Also shown in the electron gun 26 are a plurality of magnetic members 46 mounted on the floor of the shield cup 44 for the purpose of coma correction of the raster produced by the electron beams as they are scanned over the screen 22. The coma correction magnetic members 46 may, for example, be as those described in the above-referenced Hughes patent.

The tubular cathode 34 of the electron gun 26 includes a planar emitting surface 48 on an end wall thereof. The G1 and G2 electrodes include transverse plates 50 and 52, respectively, which have aligned apertures 54 and 56, respectively, therein. The G2 aperture 56 is a composite aperture as described in detail hereinafter. The G3 comprises an elongated tubular member having a transverse wall 58 adjacent to the G2, which has an aperture 60 therein. The G4, like the G3, comprises a tubular member; and these two electrodes, at their facing ends, have inturned tubular lips 62 and 64 between which the main focusing lens of the electron gun is established.

FIGS. 3, 4, 5 and 6 illustrate in detail the beam forming region of the electron gun 26. The transverse plate 52 of the G2 38 includes a first plate portion 70 and a second plate portion 72. The first plate portion 70 may comprise the G2 electrode substantially as shown in our copending application. The first plate portion 70 thus includes an electron beam aperture 74 therethrough which is preferably circular in cross section. The second plate portion 72 is laminated flush against the surface of the first plate portion 70 on the side thereof facing the G1. The second plate portion 72 is provided with an elongated slot, preferably in the form of a rectangular aperture 76 therethrough, which is aligned with the circular aperture 74 in the first plate portion 70. In the 3-beam gun 26 there are three circular apertures 74 in the first plate portion 70 and three corresponding rectangular slot apertures 76 in the second plate portion 72. The circular aperture 74 together with the rectangular slot aperture 76 constitute the composite electron beam aperture 56.

Although the second plate portion 72 is shown to have three separate rectangular slot openings 76 therein, these slot openings can be provided if desired as a single slot extending across all three apertures 74. As will be pointed out hereinafter, the lengths of the slot apertures 76 are not critical provided they are long enough as to exert no significant field forming effect on the electron beams in the horizontal direction.

Although the first and second plate portions 70 and 72 are illustrated herein as comprising separate pieces laminated together, they may be provided as different portions of a single integral electrode. In this respect the rectangular slot aperture 76 would have a depth less than the total thickness of the transverse plate 52, and the electron beam aperture 74 would be disposed in the floor of the slot aperture 76 and extend through the remaining thickness of the transverse plate 52.

Figure 5:
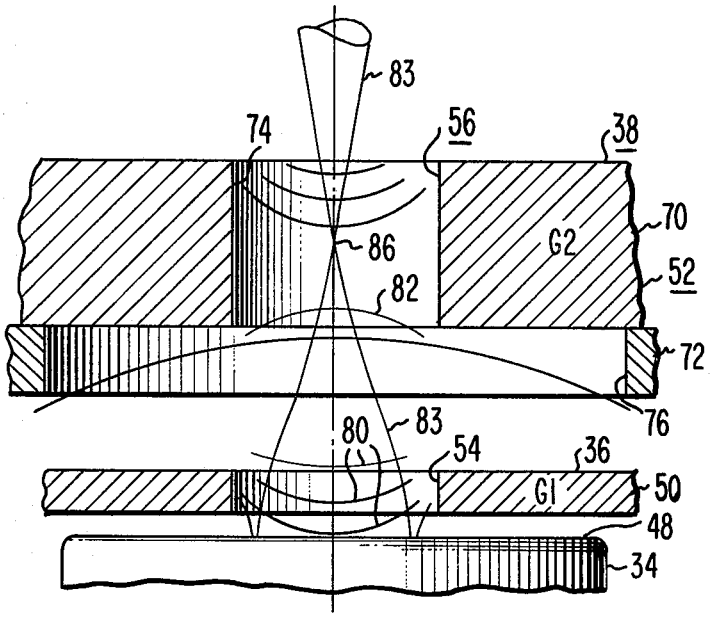
FIG. 5 is an enlarged section, taken along line 5—5 of FIG. 4, illustrating formation of the electron beam in a horizontal plane.
Figure 6:
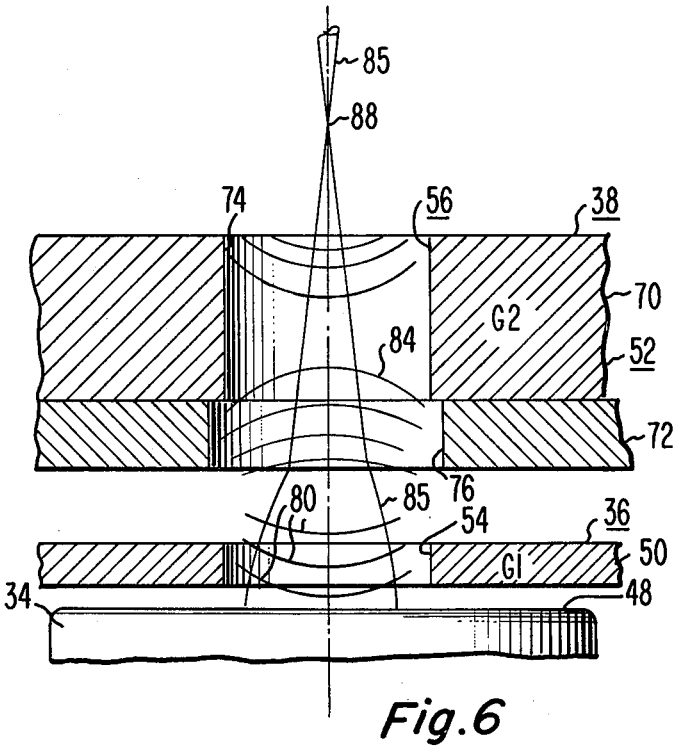
FIG. 6 is an enlarged section, taken along line 6—6 of FIG. 4, illustrating the formation of the electron beam in a vertical plane.

As illustrated in FIGS. 5 and 6, electrons emitted from the cathode 34 are focussed toward a crossover by a rotationally symmetric electric field having converging field lines 80 which dip into the circular G1 aperture toward the cathode. Also as shown in FIGS. 5 and 6, an astigmatic electric field is established at the beam entrance side of the G2 aperture 56. This field acts differently on convergent electron rays in a horizontal plane than it does on convergent electron rays in a vertical plane.

As shown in FIG. 5, diverging field lines 82 of this astigmatic field which lie in a horizontal plane produce a slight straightening of the electron beam rays so as to provide a relatively narrow angle crossover as described in our copending application. The electron trajectories as illustrated in FIG. 5 show the outermost rays 83 in a horizontal plane. FIG. 6 shows a similar view wherein diverging field lines 84 of the astigmatic field which lie in a vertical plane are more sharply curved than are the field lines 82, and thus produce a stronger field than that produced by, the field lines 82. As a result, the outermost electron rays 85 in the vertical plane undergo a greater straightening, and therefore converge with an even shallower crossover angle to a crossover farther forward than that experienced by the horizontal rays shown in FIG. 5. The result is a two-part crossover with a first line crossover 86 of the horizontally converging rays and a farther forward line crossover 88 of the vertically converging rays. The result of this is that the composite beam includes horizontally converging rays which are focused to a line, or elongated point, on the phosphor screen of the tube whereas the vertically converging rays are underfocused and actually converge to a line, or elongated point, beyond the phosphor screen. This condition produces an electron beam spot at the center of the screen which has a vertical dimension greater than the horizontal dimension because of the underconvergence of the vertical rays of the beam.

Although the electron beam spot at the center of the screen has a greater vertical dimension than horizontal dimension, just the opposite is true of the beam cross section as it passes through the main focus lens of the gun. There, because of the smaller crossover angle in the vertical plane, the electron beam has a smaller vertical than horizontal dimension. As a result, any deflection of the beam off axis due to the fringing yoke field in the vertical direction does not as severely affect the beam, since the beam does not move as fully into the aberrated portion of the lens. Thus, vertical flare due to the fringing yoke field is reduced.

Moreover, since the composite beam is characterized by underconvergence in the vertical plane, that underconvergence compensates for the vertical overconvergence which the yoke field exerts upon the beam. Accordingly, the vertical flare, both above and below the electron beam in off-center positions on the screen, is significantly reduced.

The table below gives one set of dimensions and voltages used in the preferred practice of the invention.

| | mils | mm |
|---|---|---|
| Cathode - G1 spacing (hot) | 3 | 0.076 |
| G1 thickness | 5 | 0.127 |
| G1 aperture diameter | 25 | 0.635 |
| G1–G2 spacing | 9 | 0.229 |
| G2 plate 70 thickness | 20 | 0.508 |
| G2 plate 72 thickness | 8 | 0.203 |
| G2 aperture 74 diameter | 25 | 0.635 |
| G2 slot width | 28 | 0.711 |
| G2 slot length | 84 | 2.134 |
| G2–G3 spacing | 33 | 0.838 |
| G3 aperture 60 diameter | 60 | 1.524 |
| G3 length | 925 | 23.495 |
| G3 lens diameter | 214 | 5.436 |
| G4 lens diameter | 227 | 5.766 |
| G3–G4 spacing | 50 | 1.270 |
| | volts | |
| Cathode cut-off potential | 150 | |
| G1 potential | 0 | |
| G2 potential | 600 | |
| G3 potential | 8500 | |
| G4 potential | 30000 | |

GENERAL DESIGN CONSIDERATIONS

The beam forming aperture 74 of the G2 is preferably circular in cross-section, although other cross-sectional shapes can be employed. Circularity of the aperture 74 is preferred because a circular beam spot on the screen is ideally desired. Accordingly, it is desirable to introduce a limited amount of astigmatism into the G2 beam forming region so that the undesirable flare of the beam spot can be eliminated without distorting the shape of the main intense core of the beam spot from its otherwise desired circular symmetry. If the beam forming aperture 74 is made noncircular it can, while desirably reducing flare, also have the undesirable effect of distorting the beam spot away from circular symmetry.

The horizontal length of the slot aperture 76 is not critical as long as it is great enough to exert no significant effect on the horizontally converging rays of the electron beam. It has been found that a length of at least five times as great as the thickness of the second plate portion 72 will result in the desirable absence of any adverse effect on the electron rays of the beam.

The lateral extent of the second plate portion in a direction away from the slot is likewise not critical and may be so little as to take on the appearance of a pair of rails on opposite sides of the electron beam aperture. In this respect the rail-like structure could comprise two rails extending alongside all three apertures 74 or three pair of rails with each pair flanking a different one of the apertures 74.

In order to obtain the desired astigmatic effect in the beam forming region, the width of the slot aperture 76 in the vertical plane should be from 2 to 5 times the thickness of the second plate portion 72. Furthermore, the thickness of the second plate portion 72 should not exceed the diameter of the beam forming aperture 74, otherwise the divergence effects of the field lines 84 are so great as to adversely affect the desirable crossover optics of the beam forming region in a manner inconsistent with the teachings in our copending application. It has been found that when the thickness of the second plate portion 72 is increased much beyond 0.8 times the diameter of the aperture 74 the quality of the beam forming optics degenerates rapidly. For a gun with an aperture 74 of 25 mils (0.635 mm) diameter, the second plate portion 72 is preferably not thicker than 20 mils (0.508 mm).

Conversely, the thickness of the second plate portion 72 should not be so small as to require a slot width significantly less than the diameter of the G2 aperture 74. Although the width of the slot aperture 76 can be less than the diameter of the beam forming aperture 74, when it is made excessively less, the mechanical tolerance of alignment between the slot aperture 76 and the beam forming aperture 74 becomes critical. Experience has shown that with a beam forming aperture 74 of 25 mils (0.635 mm) diameter, the second plate portion 72 can be made as little as 3 mils (0.076 mm) thick. However, if the thickness is made much less than about 6 mils (0.152 mm), the width of the slot aperture 76 must be sufficiently toward the high end of the slot width/thickness ratio range of 2–5 that an optimum slot width cannot be utilized. It is therefore preferred that the thickness of the second plate portion 72 be 0.24–0.8 times the diameter of the electron beam aperture 74.

It has also been found that in a thick G2 gun, the total thickness of the transverse plate 52 (sum of thicknesses of the first and second plate portions 70 and 72) should not exceed about 1.2 times the diameter of the G2 beam forming aperture 74. Thus, for a first plate portion 20 mils (0.508 mm) thick, when the second plate portion is increased beyond 10 mils (0.254 mm), the first plate portion should be correspondingly decreased below 20 mils (0.508 mm), otherwise the beam forming optics are severly distorted. As disclosed in our copending application, the thickness of the first plate portion 70 should be 0.4–1.0 times the diameter of the electron beam aperture 74.

Various means are disclosed in the prior art for generating an astigmatic field in the beam forming region of a gun to provide a desirable and/or compensating distortion of the electron beam. For example, U.S. Pat. No. 3,952,224, issued to J. Evans on Apr. 20, 1976 discloses an electron gun having elliptical apertures in both the G1 and G2. U.S. Pat. No. 3,866,081, issued to J. Hasker et al. on Feb. 11, 1975 shows an elliptical G2 aperture with a rectangular opening in tandum therewith. And a paper entitled "30AX Self Aligning 110° In-Line Color TV Display", presented by P. G. J. Barten and J. Kaashoek at the IEEE Conference, June 6, 1978 describes a laminated G1 having crossed rectangular apertures in the two laminated plates thereof.

While all of these prior art techniques have proved to be more or less effective in certain electron guns for dealing with the problem of vertical flare, none has proved to be ideally satisfactory for electron guns employing thick G2 electrodes as disclosed in our copending application. By contrast, the present invention can substantially eliminate the troublesome existence of vertical flare as described herein. The present invention is therefore particularly useful in dealing with this problem in thick G2 guns. However, because of its superior treatment of the vertical flare problem, it may advantageously be used in other electron guns including those which might otherwise be effectively corrected by various prior art methods.

If, as in many prior art approaches, astigmatic field means is employed on the G3 side of the G2 to obtain underconvergence of the beam in the vertical plane, it does so by operating on the beam forming optics subsequent to crossover at the sacrifice of increasing magnification. Furthermore, it does so by operating on the electrons in a relatively high electron velocity region with a consequent less sensitive correction for a given physical distortion of the gun structure. Excessive structural distortions are to be avoided if possible because they often produce instabilities of the electron optics and/or reduced fabrication tolerances for mechanical alignment of the electrodes and their parts. Thus, even in conventional thin G2 guns such practice is not equivalent to the novel gun described herein.

Although vertical flare at the off-center portions of the screen can be virtually eliminated with the novel G2, it may be that one would choose to only partially eliminate it. This possibility arises from the fact that reduction of flare at the periphery of the screen is a trade-off against an increase in the vertical dimension of the intense spot core at the center of the screen. However, a small increase in spot core at the center allows a relatively large reduction in spot flare at the periphery. Furthermore, an increase in spot core at the center also has the desirable advantage of reducing moire problems which are most noticable in the center of the screen. Moreover, where written material is displayed over the entire screen, it is most desirable to more nearly equalize the resolution capabilities of the entire screen; and this can be done by providing a large reduction in flare at the expense of a slight increase of center spot size.

What is claimed is:

1. A cathode ray tube comprising an image screen and an electron gun for projecting an electron beam onto said screen, said gun comprising:

a cathode, a control grid, a screen grid, and electron lens means adapted to focus electrons from said cathode onto said screen, said screen grid comprising a first plate portion which is transverse to said beam path and which contains a circular electron beam aperture therethrough, and a second plate portion flush with said first plate on the side thereof facing said cathode which may be either attached to or integral with said first plate portion, and which contains a slot therethrough into which said electron beam aperture opens.

2. The cathode ray tube of claim 1 wherein said slot has a width 2 to 5 times the thickness of said second plate portion.

3. The cathode ray tube of claim 1 wherein said second plate portion has a thickness equal to or less than 0.8 times the diameter of said electron beam aperture.

4. The cathode ray tube of claim 3 wherein said electron beam aperture has a diameter of about 25 mils and said second plate portion has a thickness of from 3 to 20 mils.

5. An electron gun comprising in the order named (a) a cathode, a control grid, a screen grid, and at least one focusing electrode, for generating and projecting electrons from said cathode in a beam along a beam path, (b) said screen grid including a first plate portion transverse to said beam path and having a circular aperture therethrough, the thickness of said first plate portion being 0.4 to 1.0 times the diameter of said aperture, and astigmatic means comprising a second plate portion facing said control grid and having a rectangular slot therethrough, said slot having a width 2 to 5 times the thickness of said second plate portion, (c) said plate portions being in mutual face to face contact either as separate pieces or as integral parts of a single piece.

6. The electron gun of claim 5 wherein said gun is one of three coplanar guns and said slot is elongated in the plane of said coplanar guns.

7. The electron gun of claim 5 wherein said second plate portion has a thickness not greater than the diameter of said aperture.

8. An electron gun comprising in the order named (a) a cathode, a control grid, and a screen grid for generating and projecting electrons from said cathode in a beam along a beam path, (b) said screen grid including a plate transverse to said beam path and having a compound astigmatic aperture therethrough, said aperture comprising a rectangular slot on the side of said plate facing said cathode which extends into said plate a depth less than the thickness of said plate and a circular electron beam aperture disposed in the floor of said slot and extending through the remainder of said plate, said slot having a width larger than the diameter of said circular electron beam aperture.

9. The electron gun of claim 8 wherein said slot has a width/depth ratio in the range of 2 to 5.

10. The electron gun of claim 9 wherein said slot width is not significantly less than the diameter of said electron beam aperture.

11. The electron gun of claim 9 wherein said second plate portion has a thickness equal to or less than 0.8 times the diameter of said electron beam aperture.

12. The electron gun of claim 11 wherein the thickness of said second plate portion is 0.24 to 0.8 times the diameter of said electron beam aperture.

* * * * *